US005487248A

United States Patent [19]

Artzer

[11] Patent Number: 5,487,248

[45] Date of Patent: Jan. 30, 1996

[54] STRUCTURAL PANEL

[76] Inventor: Richard F. Artzer, 27261 Via Capri, San Juan Capistrano, Calif. 92675

[21] Appl. No.: 155,526

[22] Filed: Nov. 22, 1993

[51] Int. Cl.[6] ..... E04C 2/26

[52] U.S. Cl. ..... 52/309.12; 52/309.11; 52/309.14; 52/572

[58] Field of Search ..... 52/220.2, 220.3, 52/220.4, 405.1, 405.3, 309.11, 309.12, 309.14, 309.17, 309.9, 569, 572

[56] References Cited

U.S. PATENT DOCUMENTS

| | | | |
|---|---|---|---|
| 733,928 | 7/1903 | Ferguson | 52/572 |
| 1,727,363 | 9/1929 | Bone | 52/220.2 X |
| 4,125,981 | 11/1978 | MacLeod et al. | 52/309.12 |
| 4,226,067 | 10/1980 | Artzer | 52/309.12 |
| 4,253,288 | 3/1981 | Chun | 52/309.11 X |
| 4,263,765 | 4/1981 | Maloney | 52/309.11 X |
| 4,297,820 | 11/1981 | Artzer | 52/309.11 |
| 4,324,080 | 4/1982 | Mullins | 52/405.3 X |
| 4,336,676 | 6/1982 | Artzer | 52/309.12 X |
| 4,943,336 | 7/1990 | Csont | 52/309.14 X |

FOREIGN PATENT DOCUMENTS

| | | | |
|---|---|---|---|
| 552451 | 12/1956 | Italy | 52/572 |

*Primary Examiner*—Carl D. Friedman
*Assistant Examiner*—Kevin D. Wilkens
*Attorney, Agent, or Firm*—G. Donald Weber, Jr.

[57] ABSTRACT

A structural panel, including a plurality of contiguous elongated filler members mutually contiguous ones of the filler members having opposed surfaces pressed against one another in vapor tight face-to-face contact with each other and having opposite side surfaces extending from the opposed surfaces, a three-dimensional supporting matrix, including a plurality of lattice structures, each being interposed between and pressed into adjacent surfaces of the members, each of the lattice structures having opposite side portions projecting slightly beyond the opposite side surfaces of the members, and a mesh of wire, in the form of lateral and longitudinal wires attached together at their right angle intersections extending across the filler members, the members being fixed to the projecting opposite side portions of the lattice structures by C-clips to thereby hold the lattice structures and filler members pressed together in a unitary panel configuration.

7 Claims, 2 Drawing Sheets

STRUCTURAL PANEL

BACKGROUND OF THE INVENTION

1. Field of the Invention

This invention relates to, generally, construction materials. More particularly, the invention relates to, structural panels employing lightweight foam filler materials enclosed in a wire matrix to provide, when faced with cementatious coverings, a lightweight, extremely strong building component.

2. Description of the Prior Art

Pre-fabricated structural panels have found increased utilization in the manufacture of certain structures such as houses, factories and other commercial buildings. Such panels are made in a factory to provide lower overall manufacturing costs and allow faster construction than is obtainable with on-site piecemeal construction processes.

The use of lightweight plastic foams such as synthetic resins and expanded plastic foams, such as polyurethane, polystyrene and the like, exhibit a number of properties that are highly desirable as building materials, such as lightweight, low thermal conductivity, impermeability to moisture, and extremely good acoustic and heat insulation. Such materials are already known to be included in structural panels of the type shown in U.S. Pat. No. 4,226,067. In these panels, lightweight expanded polystyrene foam is combined with wire lattices wherein the lattices are machine welded together with a wire mesh to provide an extremely strong, lightweight structural panel. Other examples of prior art structural panels are those found in U.S. Pat. Nos. 3,305,991; 3,555,131; 3,879,908; 4,291,732; 4,297,820; 4,336,676; and 4,340,802.

In these prior art patents, a structural panel and a technique for manufacturing thereof are disclosed in which a 3-dimensional reinforcing framework is first built up and then a lightweight plastic core is formed in situ within the framework, and positioned so that the outer surfaces of the resulting formed-in-place core are, hopefully, located inwardly of the outer boundaries of the 3-dimensional framework.

In U.S. Pat. 4,226,067,by the same inventor, a plurality of elongated foam filler elements are stacked with a flat lattice structure interposed therebetween. The lattice structure contains a sinusoidal strengthening member which is substantially wider than the foam elements. This stacked arrangement is then subject to vertical pressure to cause each of the lattice structures to become imbedded in the contiguous faces of the foam filler members. Thereafter, a wire mesh is welded to the protuding ends of the lattice structures to hold the lattice structures and filler elements in a configuration defining a flat, structural panel.

While this structural panel exhibits physical properties found useful in the construction industry, certain drawbacks exist that render the panels less than satisfactory in many situations. For instance, for welding the wire mesh to the exposed ends of the lattice structures, a space of at least three-fourths of an inch must be maintained between the wire mesh and the surface of the foam to allow the machine welding heads to grasp the intersecting wires to achieve a good weld. Thereafter, a substantial amount of plaster must be used to fill the space between the foam and the exposed ends of the lattice structure. This heavy layer of plaster causes the structure to be heavier than desired.

Further, machines designed to make these foam-filled panels of the prior art require a substantial plurality of welding heads, each fixed at a specific location to make the welds necessary for a full panel. These are situations, for instance when a panel is to be used as a flooring panel, wherein a heavier wire is desired to be made a part of the mesh or wires welded to the exposed ends of the lattice member. In these situations, a heavier wire cannot be utilized with these machines without adjusting the numerous welding heads and their spaced distance from the foam and adjusting the current applied during the welding process. These adjustments slow the manufacturing process and increase panel manufacturing costs. In addition, there are situations where panels are desired to be made with foam elements of 6 inches, 8 inches, 10 inches and 12 inches in size. Under present processes, none of the machinery of the prior art can make these different size panels without extensive re-calibration and resetting of the welding heads, thus slowing the manufacturing process and increasing overall costs.

Still further, in the prior art, if any panel is cut at an angle,the cutaway portion is totally useless for any further structural need. That is, the foam members are interconnected through the welded lattice structures and, thus, are unavailable for piecemeal utilization. The structural panels of the prior art also use solid foam elements that require partial cutting away for introduction of electrical wires and piping into the wall. Finally, it has been determined that the welding of the wire mesh to the exposed ends of the lattice structure causes noticable weakening in the metal wire adjacent the welds thus weakening the overall integrity of the structure. While the manufacturing and assembly costs of the panels remain low, the necessity to cut away part of the foam to allow passage of wires and pipes interior of the wall requires more handwork than normal, thus, increasing these assembly costs.

SUMMARY OF THE INVENTION

This invention is an improvement over the structural panels of the prior art and in the manner in which the panels are assembled. The invention overcomes or reduces to manageable levels, the problems in the prior art previously described. While the structural panels of this invention continue to utilize the stack of foam filler elements with wire lattices and the subsequent compression to press the lattices into the foam, the attachment of the wire mesh over the exposed ends of the lattice is now made with C-rings by hand using a powered C-ring gun. The use of a mechanical connection by C-ring between the wire mesh and the exposed ends of the truss allows all the wires to retain their full mechanical strength and not be weakened as in the case of welding. Panels of different sizes, namely 6 inches, 8 inches, 10 inches and 12 inches high, can easily be stacked alternately with different sized foam elements, subjected to the compression and thereafter quickly interconnected through the wire mesh by the use of C-rings. This invention enhances the low cost manufacturing procedures by eliminating the step for adjusting the welding machines.

Still further, in this invention, a three-quarter inch gap need not be maintained between the surface of the foam and the intersection of the wire mesh with the exposed ends of the wire lattice to allow the welding heads to properly make a connection therebetween. With the new C-ring manufacturing technique, the exposed ends of the lattice may be brought virtually adjacent the surface of the foam. One advantage of this structure is that it allows a larger size foam to be used with the concomitant improved thermal insulation, noise insulation, and other desirable features. Alternatively, a lighter foam panel is produced inasmuch as the amount of plaster needed to fill the space between the foam and mesh is substantially reduced. With this new invention, panels can now be made wherein heavier wires can be added periodically throughout the mesh and connected mechanically to the exposed ends of the wire lattice by C-ring connection. Thus, the panel may be used as flooring without redesigning or totally readjusting the welding machines as required in the prior art.

Finally, by the use of novel hot wire cutting procedures, a typical 6 inch foam element can be cut and, effectively, increased in overall size to 8 inches in a least one direction to form air gaps in the middle of the wall panel. These gaps allow for the passage of pipes, tubes and wires thereby greatly reducing the time involved by electricians, plumbers and the like. The air gaps further add substantially more insulation value to the wall panel then is possible with a solid foam filler element.

Accordingly, the main object of this invention is a novel and improved structural panel that may be made in a wide variety of sizes and shapes for complementary interaction with other building materials by completing the interconnection between the wire lattice and the fixating wire mesh by use of mechanical connections in lieu of the prior art welding connections. Other objects of the invention include a structural panel requiring less plaster to cover over the gap between the foam surface and the connection between the wire mesh and the wire lattice; a structural panel that is buildable in a variety of sizes and not restrained by the fixed position of welding heads in a manufacturing machine; a structural panel that may be cut to fit a specific job and render the cutaway portion susceptible of further use, individually or as part of another structure; and, a structural panel usable as floor panels because of the introduction of larger, stronger wires at specific locations througout the assembly of the lattice work. These and other objects of the invention will become more apparent when reading the following description of the preferred embodiment along with the drawings that are appended hereto. The scope of the protection sought by the inventor may be gleaned from a fair reading of the claims that conclude this specification.

DESCRIPTION OF THE PREFERRED EMBODIMENT

Figure 2:
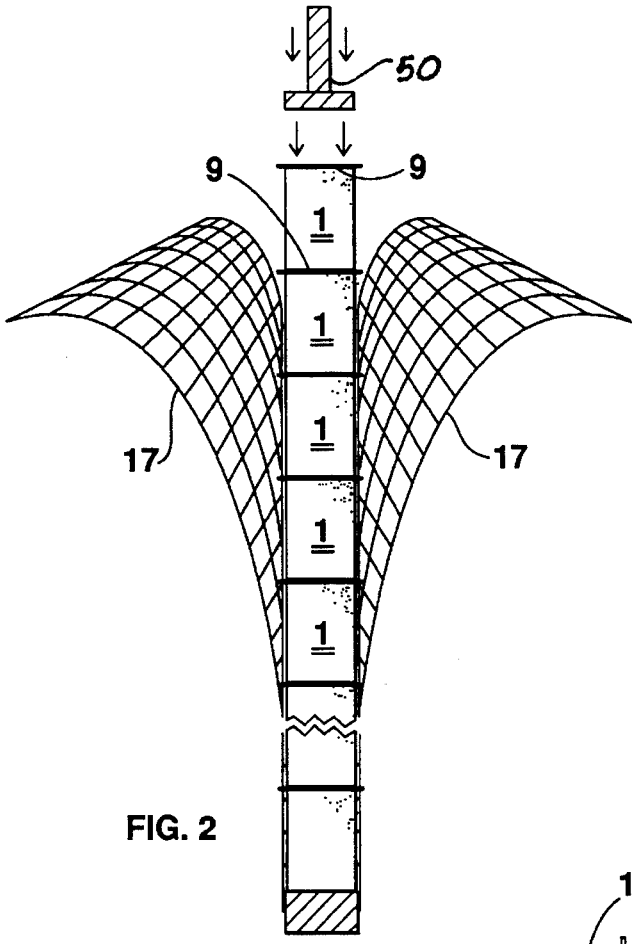
FIG. 2 illustrates positioning of the cross wires adjacent opposite sides of the compressed sub-assembly of the filler elements and interposed lattice structure.
Figure 1:
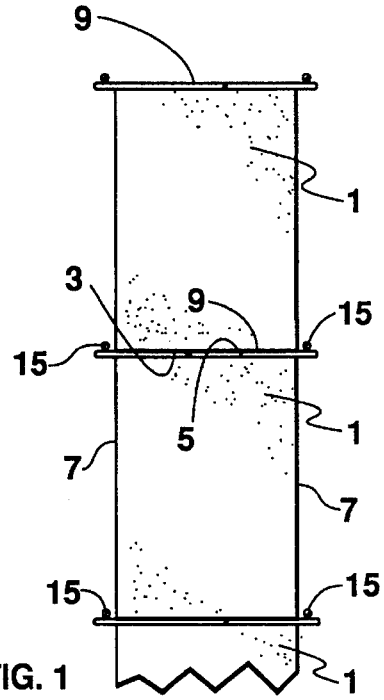
FIG. 1 is an illustrative view of a sub-assembly of a panel in partly assembled condition prior to vertical compression.
Figure 3:
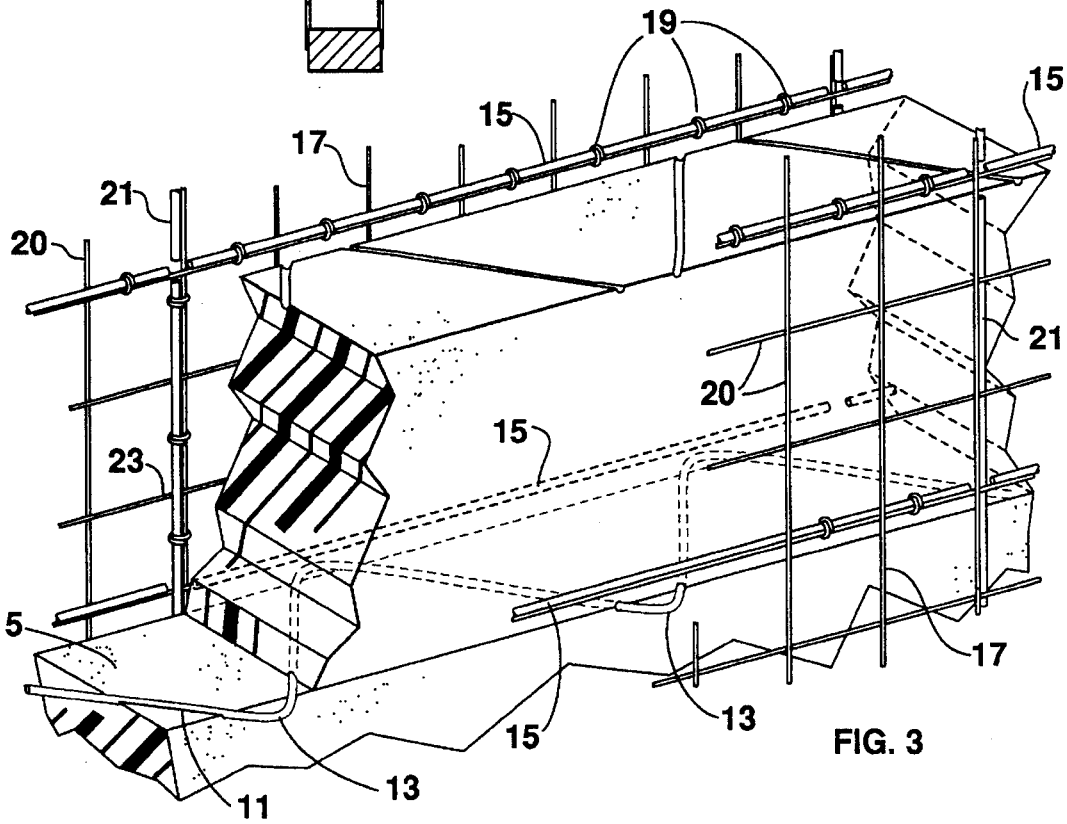
FIG. 3 is a broken away view illustrating the relation of lattice structure and filler elements of the finished panel.

Turning now to the drawings wherein like elements are identified with like numerals throughout the five drawings, FIGS. 1 through 3 show the general outline of the structural panel of this invention. As shown, a plurality of elongated filler members 1 lay in mutually contiguous arrangement and have opposed surfaces 3 and 5 pressed together against one another in vapor-tight, face-to-face contact with each other.

Elongated filler members 1 may be made from a variety of foamed resinous polymeric materials that are solid when cured such as polystyrene, polyurethane and polyvinylchloride materials. The primary requisites for the foam are that it be lightweight, retain sufficient physical strength to be useful over a long period of time, be generally unaffected by moisture and changes in temperature, and have good heat and noise insulation properties.

Each elongated filled member has opposite side surfaces 7 extending generally normal to said mutually opposed surfaces 3 and 5 as shown in FIG. 3. A rectilinear cross-section is preferred.

As shown in FIGS. 1 through 3, the structure panel 100 of this invention includes a plurality of elongated filler members 1 in face-to-face contact at surfaces 3 and 5. Between the rows of filler members 1 are placed lattice structures 9 of the type shown in FIG. 3. The lattice structures include a wire 11, shown bent in zig-zag fashion and having a series of bends 13. A pair of mutually spaced apart end rods 15 and laid in parallel fashion along the bends 13 of wire 11 and welded or otherwise attached to said bends to provide a three-element lattice structure 9 having a generally planar configuration. Center wire 11 is bent wide enough to place bands 13 beyond opposite side surfaces 7 of the filler members 1.

As shown in FIG. 2, a vertical downward pressure is thereafter applied to the layered filler members and lattice structures by a suitable press 50. Thus, lattice structures 9 are imbedded in the mutually opposed surfaces 3 and 5 of each member. The resultant structure is a plurality of foam members 1 stacked together wherein the mutually opposed surfaces 3 and 5 are held tightly together with the layers of lattice structures imbedded in surfaces 3 and 5.

Figure 4A:
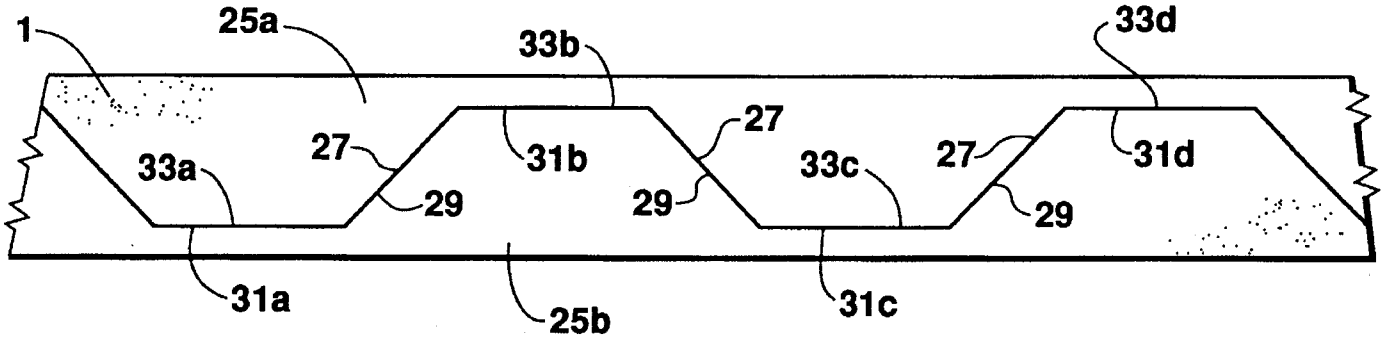
FIG. 4*a* is a top view of a filler element cut with a hot wire into two individual sections; and, FIG. 4*b* is an assembled view of the filler element shown in FIG. 4*a* along with the lattice work to provide interior passageways in the panel.
Figure 4B:
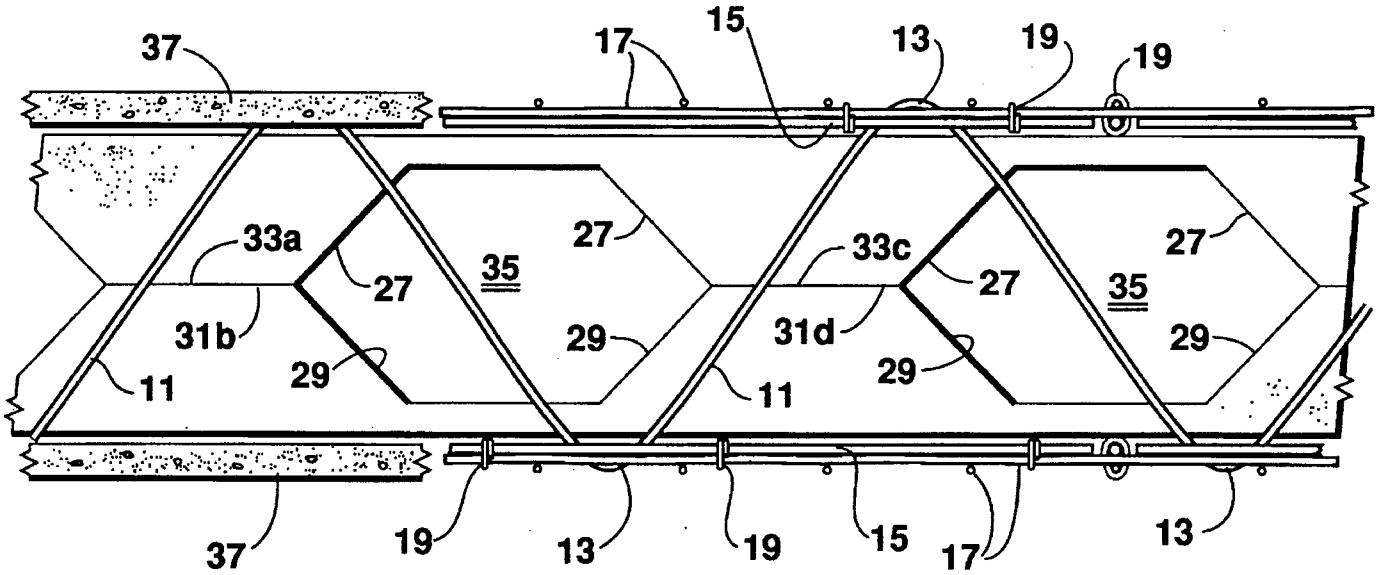

A mesh 17, formed of lateral and longitudinal wires attached together preferably by welding at the right angle intersections, is laid against end rods 15 and attached thereto by C-clips 19 as shown in FIGS. 3, 4a, and 4b. Mesh 17 is preferrably attached to both sides of lattice structure 9, i.e. along both end rods 15 so that the resulting structural panel contains filler members 1, alternate layers of lattice structure 9 with overlays on both sides of mesh 17, C-clipped to lattice structure end rods 15. Lattice structure 9 may be made of a size wherein end rods 15 are placed close to, e.g. within a sixteenth of an inch, against filler member opposite side surfaces 7 of filler members 1. A desirable property of the overall panel is achieved by the use of C-clips. That is the panels will flex slightly under varying load, yet remain in place and support the load applied to them. This makes the panels extremely useful in areas subject to earthquakes or other earth temblor phenomenon.

Using C-clips 19 allows mesh 17 to be brought closer to side surfaces 7 than heretofore permitted in the prior art. That is, the machinery used to manufacture the prior art structural panels required that a substantial distance be maintained between surfaces 7 and lattice structure end rods 15 to allow positioning of the welding heads sufficient to weld end rods 15 to lattice structure 9. In this invention, the complete lattice structure, including the center wire 11 and end rods 15 are formed to completion before interlaying them with alternate layers of elongated filler members 1.

C-clips 19 are small C-shaped open metal rings that fit in a magazine in an installation device, which may be pneumatic, hydraulic or electrically powered. The installation device includes a pair of fingers extending from the front of the tool for guiding the C-clip 19 over mesh 17 and end rods 15. Thereafter, with a touch of the trigger, the fingers are caused to come toward each other thereby closing the C-clip in a full circle about mesh 17 and end rods 15.

The use of mechanical C-clips 19 to fix mesh 17 to center wire 11, as opposed to welding, as shown in the prior art, allows mesh 17 to be positioned extremely close to opposite side surfaces 7 of elongated filler members 1 so that less plaster and other cementatious material is needed to cover over wire mesh 17, thus making the structural panel far lighter in weight than previously obtainable.

In use, the structural panel of this invention is arranged horizontally or vertically. In addition, by increasing the size of some, e.g. alternate or every other, wire in wire mesh 17 such as from a 14 gauge 20 wire (used in the mesh) to a 12 gauge wire 21 on 6 inch centers within the mesh, the structural panel of this invention may be used as a floor panel as well as a vertical side panel or angled roof panel. Mesh 17 is composed of laterally disposed wires 21 and longitudinally disposed wires 23. For the purpose of utilizing the structural panel for higher strength requirements such as floor panels, the larger wires may be disposed laterally or longitudinally or both laterally and longitudinally.

Another novel feature of this invention is shown in FIGS. 4*a* and 4*b* wherein an elongated foam filler member 1 is cut completely through along both opposed surfaces 3 and 5, by a hot wire or other foam cutting device, in a semi-zig-zag pattern into two pieces 25*a* and 25*b*. Each piece 25*a* and 25*b* has a set of mutually facing slant surfaces 27 and 29 spaced therealong interrupted by a series of offset mutually facing flat surfaces 31*a*, 31*b*, 31*c*, and so forth, and 33*a*, 33*b*, 33*c*, and so forth that are parallel to the opposite side surfaces 7. Thereafter, pieces 25*a* and 25*b* are pulled apart and shifted slightly past each other. The flat surfaces then align in mutual pairs of abutting surfaces, e.g. 31*b*–33*a*, 31*d*–33*c*, and so forth. The slant surfaces 27 and 29 no longer contact each other and, in conjunction with flat surfaces 31*c*, 31*c*, 33*b* and 33*d*, for example, form air-filled chambers 35. Abutting surfaces, such as surfaces 31*b*–33*a* may thereafter be glued together and stacked to form a wider lattice structure 9, as shown in FIG. 4*b*. Thus, the overall panel is wider and contains therein chambers 35 running mutually parallel to and between opposed side surfaces 7. By carefully cutting each filler member 1 in a zig-zag fashion longitudinally therealong and further carefully arranging the alternate layers of glued together cut members 25*a* and 25*b* with wider lattice structures 9, the structural panel may be fabricated with mesh 17 on both side surfaces 7 such that air pockets of chamber 27 are aligned to form tunnels for the passage of wires, pipes, tubing and other elongated structures normally encountered in construction.

As shown in FIG. 4*b*, after assembly and installation in the structure to be built, the outer surfaces of the panels are covered with a layer 37 of standard plaster or stucco that begins at filler member side surface 7 and progresses outwardly slightly beyond wire mesh 17 so that the panel takes on a smooth or finished surface. A plurality of separate coats or layers may be built up, as is already known in the art, to provide different outer surfaces of finishes.

While the invention has been described with reference to a particular embodiment thereof, those skilled in the art will be able to make various modifications to the described embodiment of the invention without departing from the true spirit and scope thereof. It is intended that all combinations of elements and steps which perform substantially the same function in substantially the way to achieve substantially the same result are within the scope of this invention.

What is claimed is:

1. A structural panel comprising:

a plurality of contiguous elongated filled members;

each of said filler members formed of a foamed, resinous material;

each of said filler members having a top surface, a bottom surface, a pair of end surfaces, an outer surface and an inner surface;

said inner surface having slanted portions thereof intermediate flat portions thereof which flat portions are parallel to said outer surface;

mutually contiguous filler members having adjacent top and bottom surfaces and said flat portions of said inner surfaces thereof pressed against one another in vapor tight face-to-face contact whereby said slanted portions of the inner surfaces of adjacent filler members are spaced apart thereby to form chambers in said structural panel;

lattice structures interposed between and pressed into said adjacent top and bottom surfaces of said mutually contiguous filler members;

each of said lattice structures including an elongated filament wire having a zigzag configuration and a pair of substantially parallel end rods;

said elongated filament wire including a plurality of apices formed by said zigzag configuration;

said plurality of apices projecting slightly beyond each of said side surfaces of said filler members;

said end rods joined to said elongated filament wire between said apices and close to said outer surfaces of said filler member;

a wire mesh comprising lateral and longitudinal wires attached together at the intersections thereof; and a plurality of C-clips connected to said end rods and to said wire mesh thereby to hold said wire mesh close to said lattice structures and maintain said filler members pressed together in a unitary panel.

2. The structural panel of claim 1 wherein at least some of said wires of said mesh are different in size than others of said wires of said mesh.

3. The structural panel of claim 1, wherein said elongated filler members are arranged in layered form, alternately with said lattice structures, so that said plurality of chambers align to provide a series of elongated air tunnels passing through the panel between said side surfaces.

4. The structural panel of claim 1 wherein said filler members are foam and are rectilinear in configuration.

5. The structural panel of claim 1 wherein said C-clips are connected to said lateral wires of said wire mesh.

6. The structural panel of claim 1 wherein said C-clips are connected to said the longitudinal wires of said wire mesh.

7. The structural panel of claim 1 wherein said C-clips are connected to said lateral and said longitudinal wires of said wire mesh.

* * * * *